US007887673B2

(12) United States Patent
Andersson et al.

(10) Patent No.: US 7,887,673 B2
(45) Date of Patent: Feb. 15, 2011

(54) PAPER MACHINE AND METHOD FOR MANUFACTURING PAPER

(75) Inventors: Ingmar Andersson, Hammarö (SE); Sören Sven Eriksson, Sugar Hill, GA (US); Dennis Edward Jewitt, Kent (GB); Ingvar Berndt Erik Klerelid, Karlstad (SE); Anders Lindén, Karlstad (SE); Lars B. Nilsson, Karlstad (SE)

(73) Assignee: Metso Paper Karlstad, Karlstad (SE)

( * ) Notice: Subject to any disclaimer, the term of this patent is extended or adjusted under 35 U.S.C. 154(b) by 820 days.

(21) Appl. No.: 11/568,429

(22) PCT Filed: May 18, 2005

(86) PCT No.: PCT/SE2005/000713

§ 371 (c)(1),
(2), (4) Date: Jul. 16, 2007

(87) PCT Pub. No.: WO2005/116332

PCT Pub. Date: Dec. 8, 2005

(65) Prior Publication Data

US 2008/0035290 A1 Feb. 14, 2008

(30) Foreign Application Priority Data

May 26, 2004 (SE) ..... 0401331

(51) Int. Cl.
*D21F 11/14* (2006.01)
*D21F 1/48* (2006.01)

(52) U.S. Cl. ..... 162/202; 162/111; 162/203; 162/217; 162/280; 162/289; 162/363; 162/375

(58) Field of Classification Search ..... 162/109, 162/111–112, 141–142, 149, 201–207, 217, 162/280–281, 289, 308, 348, 358.1–358.2, 162/363, 375
See application file for complete search history.

(56) References Cited

U.S. PATENT DOCUMENTS 3,301,746 A * 1/1967 Sisson et al. ..... 162/113

(Continued)

FOREIGN PATENT DOCUMENTS

EP 0 440 697 5/1995

(Continued)

OTHER PUBLICATIONS

International Search Report for International Application No. PCT/SE2005/000713 completed Jun. 13, 2005.

(Continued)

*Primary Examiner*—José A Fortuna
(74) *Attorney, Agent, or Firm*—Alston & Bird LLP

(57) ABSTRACT

Paper machine for manufacturing a fiber web of paper without through air drying (TAD) or pressing, comprising: a wet end, having a wire section with at least one forming wire, a clothing, being air and water permeable, and a dewatering unit for dewatering the fiber web; and a drying section, comprising a drying surface for the fiber web; and also a transfer roll for transferring the fiber web to the drying section, wherein the fiber web is supported by said clothing from the wire section all the way to and over the transfer roll. The clothing has a three dimensional structure for structuring the fiber web.

20 Claims, 3 Drawing Sheets

U.S. PATENT DOCUMENTS

| | | | | | |
|---|---|---|---|---|---|
| 3,879,257 | A * | 4/1975 | Gentile et al. | 162/112 |
| 4,302,282 | A * | 11/1981 | Young | 162/111 |
| 4,529,480 | A * | 7/1985 | Trokhan | 162/109 |
| 4,533,437 | A * | 8/1985 | Curran et al. | 162/281 |
| 4,619,734 | A * | 10/1986 | Andersson | 162/111 |
| 4,637,859 | A * | 1/1987 | Trokhan | 162/109 |
| 4,942,077 | A * | 7/1990 | Wendt et al. | 428/152 |
| 5,230,776 | A * | 7/1993 | Andersson et al. | 162/290 |
| 5,542,455 | A | 8/1996 | Ostermayer et al. | |
| 5,569,358 | A * | 10/1996 | Cameron | 162/117 |
| 5,591,305 | A * | 1/1997 | Cameron | 162/117 |
| 5,839,479 | A | 11/1998 | Gulya et al. | |
| 5,904,811 | A * | 5/1999 | Ampulski et al. | 162/117 |
| 6,039,839 | A * | 3/2000 | Trokhan et al. | 162/116 |
| 6,287,426 | B1 | 9/2001 | Edwards et al. | |
| 6,534,151 | B2 * | 3/2003 | Merker | 428/154 |
| 6,547,925 | B1 * | 4/2003 | McCullough et al. | 162/111 |
| 6,610,619 | B2 * | 8/2003 | Friedbauer et al. | 442/320 |
| 6,733,608 | B1 | 5/2004 | Baggot et al. | |
| 6,752,907 | B2 * | 6/2004 | Edwards et al. | 162/207 |
| 6,758,943 | B2 * | 7/2004 | McConnell et al. | 162/158 |
| 6,780,282 | B2 * | 8/2004 | Scherb et al. | 162/111 |
| 6,818,101 | B2 * | 11/2004 | Vinson et al. | 162/158 |
| 6,860,968 | B1 * | 3/2005 | Chuang et al. | 162/206 |
| 6,913,673 | B2 * | 7/2005 | Baggot et al. | 162/117 |
| 7,147,751 | B2 * | 12/2006 | Shannon et al. | 162/135 |
| 2001/0032712 | A1 * | 10/2001 | Friedbauer et al. | 162/109 |
| 2002/0096302 | A1 * | 7/2002 | Thoroe Scherb et al. | 162/358.1 |
| 2002/0124978 | A1 * | 9/2002 | Hollmark et al. | 162/109 |
| 2002/0179264 | A1 * | 12/2002 | Phan et al. | 162/109 |
| 2003/0000664 | A1 * | 1/2003 | Drew et al. | 162/109 |
| 2003/0089474 | A1 | 5/2003 | Zwick et al. | |
| 2003/0121626 | A1 * | 7/2003 | Hultzcrantz | 162/111 |
| 2003/0201081 | A1 * | 10/2003 | Drew et al. | 162/111 |
| 2005/0045292 | A1 * | 3/2005 | Lindsay et al. | 162/109 |
| 2005/0167066 | A1 * | 8/2005 | Herman et al. | 162/203 |
| 2005/0241788 | A1 * | 11/2005 | Baggot et al. | 162/117 |
| 2006/0124261 | A1 * | 6/2006 | Lindsay et al. | 162/117 |
| 2006/0243404 | A1 * | 11/2006 | Scherb et al. | 162/111 |
| 2007/0251656 | A1 * | 11/2007 | Vinson et al. | 162/111 |
| 2008/0035290 | A1 * | 2/2008 | Andersson et al. | 162/135 |
| 2008/0041543 | A1 * | 2/2008 | Dyer et al. | 162/111 |
| 2008/0099170 | A1 * | 5/2008 | Ostendorf et al. | 162/112 |
| 2009/0321032 | A1 * | 12/2009 | Graf | 162/202 |
| 2010/0065234 | A1 * | 3/2010 | Klerelid et al. | 162/111 |

FOREIGN PATENT DOCUMENTS

| | | | |
|---|---|---|---|
| GB | 2152961 | A * | 8/1985 |
| WO | WO 9004676 | A1 * | 5/1990 |
| WO | WO 99/23299 | | 5/1999 |
| WO | WO 99/23303 | | 5/1999 |
| WO | WO 2005116332 | A1 * | 12/2005 |

OTHER PUBLICATIONS

Written Opinion of the International Searching Authority for International Application No. PCT/SE2005/000713 mailed Jun. 7, 2005.

Written Opinion of the International Preliminary Examining Authority for International Application No. PCT/SE2005/000713 mailed May 5, 2006.

International Preliminary Report on Patentability for International Application No. PCT/SE2005/000713 completed Apr. 9, 2006.

* cited by examiner

PAPER MACHINE AND METHOD FOR MANUFACTURING PAPER

BACKGROUND OF THE INVENTION

1) Field of the Invention

The present invention relates to a paper machine for manufacturing a fibre web of paper without through air drying (TAD) or pressing, comprising:

a wet end, comprising a wire section comprising at least one forming wire for forming the fibre web, a clothing, being air and water permeable, and at least one dewatering unit for dewatering the fibre web, a drying section, comprising a drying surface for drying the fibre web, and a transfer roll, being arranged for interacting with the drying surface at a transfer nip for transferring the fibre web from the wet end to the drying section, wherein the fibre web is supported by said clothing from the wire section all the way to and through the transfer nip.

Furthermore, the present invention relates to a method for manufacturing paper in a paper machine without through air drying (TAD) or pressing, said method comprising the steps of:

forming a fibre web in a wire section, supporting the fibre web by an air and water permeable clothing from the wire section to a drying section, and dewatering the fibre web within this distance by at least one dewatering unit, transferring the fibre web from the clothing to a drying surface of the drying section, and removing the fibre web from the drying surface.

Furthermore, the present invention relates to paper manufactured according to said method.

2) Description of Related Art

A conventional tissue machine has a press section where the paper web, being supported by one or several felts, is brought through one or several dewatering presses in order to increase the dryness of the paper web. However, dewatering presses have the negative effect, in connection with soft paper, of reducing the bulk of the final paper web, which in this type of paper machine normally does not exceed 7-10 cubic centimeters per gram.

U.S. Pat. No. 6,287,426 discloses a press-equipped paper machine, having a press section and structuring means for recreating at least some of the bulk being lost during the passage of the paper web through the press section. The structuring means is constituted of a clothing, on one hand, in the form of a structured, permeable wire carrying the paper web from the press section to the drying section of the paper machine, and of a suction device, on the other hand, being placed in sliding contact with the inside of the wire, i.e. the side facing away from the paper web, in order to suck the paper web into close contact with the wire and in that way increase the bulk of the paper web.

The structuring means according to U.S. Pat. No. 6287426 is not successful in recreating the bulk of the paper web as the web fibre framework is already fixed in the pressing and the fibres are not movable relative to each other due to the higher dryness of the web. It is difficult with such a means, or in any other way, to "repair" the bulk-destroying effect which dewatering pressing nips have on the fibre framework of a paper web. Accordingly, when manufacturing high-bulk soft crepe paper such pressing nips should be avoided.

As an alternative to pressing it is also known in the art to use a through air drying process, commonly known as TAD, for dewatering the paper web. A TAD unit comprises a perforated rotating cylinder covered by a large hood. The paper web, being supported by an air and water permeable clothing, is led over the cylinder and dry hot air is forced through the paper web and clothing and into the openings in the cylinder. The air is then re-circulated to the hood after being dewatered and dried. The TAD unit is large and complex and requires a large investment when building a TAD paper machine. Furthermore, a TAD process for dewatering the paper web is expensive as drying and re-circulation of the air requires a large amount of energy.

EP 0440697 discloses a paper machine, which in one operating configuration provides a technique free of through air drying and pressing for manufacturing high-bulk soft crêpe paper. The paper machine can be switched between a first operating configuration and a second operating configuration. In the first operating configuration, a felt is arranged, in a conventional way, for picking up the paper web from a forming wire of the wire section of the paper machine and bringing the paper web over first a press roll, and then a blind-bored roll, said rolls interacting with a Yankee cylinder in the drying section of the paper machine. In the second operating configuration, producing a paper web with higher bulk and softness values in relation to the fibre web produced in the first operating configuration, the blind-bored roll has been omitted, and furthermore, the felt has been replaced with a belt of wire type, on one hand, and the forming wire has been extended, on the other hand, so that it runs all the way to the Yankee cylinder in order to enclose the paper web between itself and the belt. Accordingly, the belt, the forming wire and the paper web constitute a sandwich structure when they are running all the way to the drying section, within which distance the paper web is dewatered while being enclosed between the belt and the forming wire.

In its second operating configuration, the paper machine according to EP 0440697 produces soft crepe paper with relative high bulk and softness values. Also this paper machine, however, exhibits drawbacks. Due to the sandwiched structure of the paper web it has proved to be difficult to achieve the desired dewatering of the paper web before the drying section, which in its turn has limited the production speed and increased drying requirements in the drying section. Also, the sandwich structure has a negative effect on the bulk of the final paper web.

BRIEF SUMMARY OF THE INVENTION

The object of the present invention is to achieve a new paper machine, free of a through air drying unit and presses, for manufacturing paper, said paper machine being simple in comparison to the previously known machines, on one hand, and capable of being operated at a high production speed, on the other hand.

The paper machine according to the invention is characterized in that the clothing exhibits a three-dimensional structure for structuring the fibre web.

The method according to the invention is characterized by the step of structuring the fibre web by means of a three-dimensional structure of the clothing.

BRIEF DESCRIPTION OF THE SEVERAL VIEWS OF THE DRAWINGS

In the following, the invention will be described in greater detail with reference to the drawings.

DETAILED DESCRIPTION OF THE INVENTION

Figure 1:
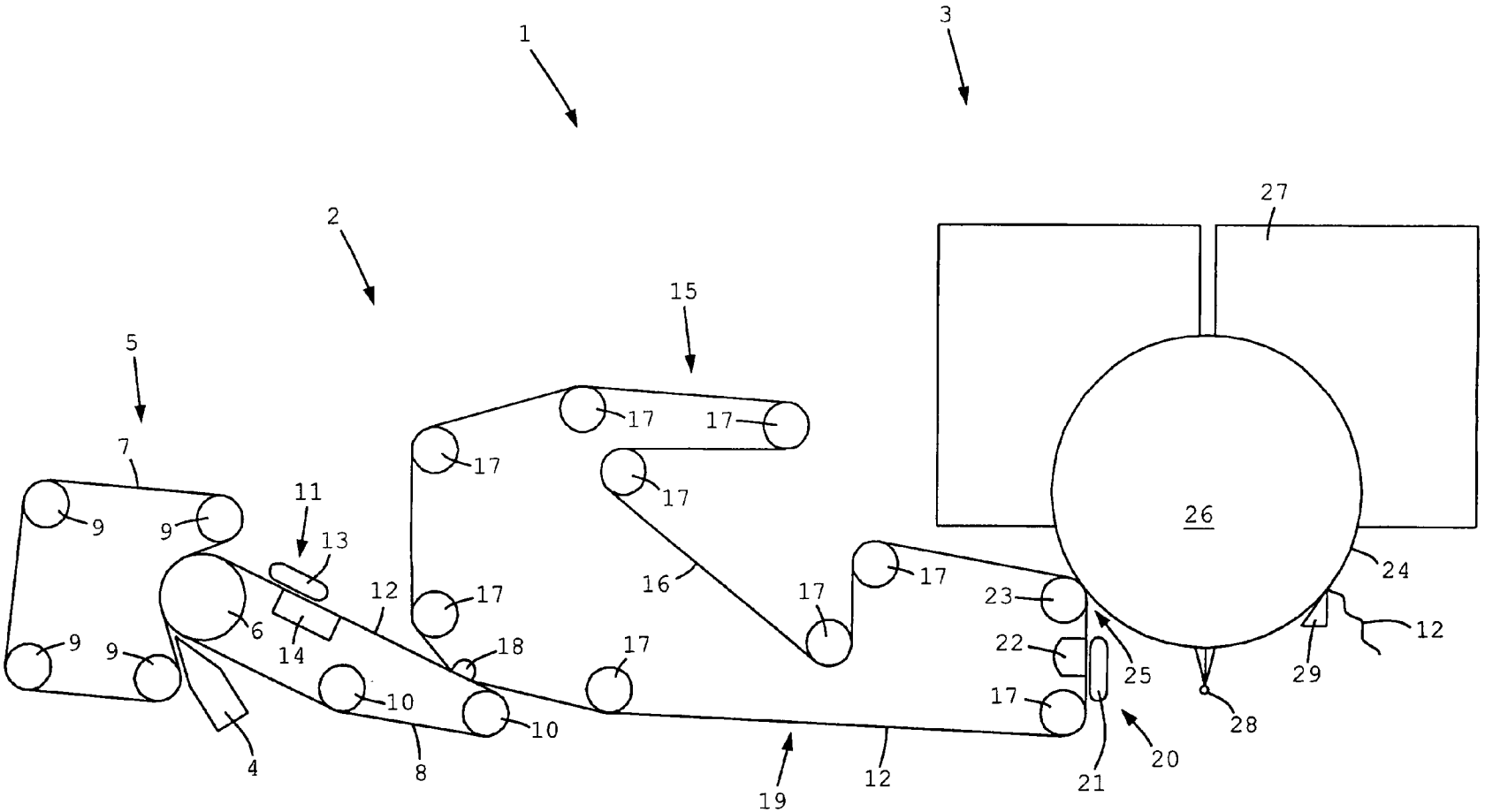
FIG. 1 shows a first embodiment of a paper machine according to the invention.

FIG. 1 is a schematic representation of a paper machine 1 for manufacturing soft crepe paper. The paper machine 1 comprises a wet end 2 and a drying section 3, but has no press section. Accordingly, the paper machine according to the invention is free of dewatering presses, i.e. it has no dewatering nips. The wet end 2 comprises a head box 4 and a wire section 5. The wire section 5, in its turn, comprises a forming roll 6 and two forming wires 7 and 8. Each of the forming wires 7, 8 runs in a closed loop around a plurality of guide rolls 9 and 10, respectively. The forming wires 7, 8 run over the forming roll 6, in a known fashion, and receive a stock jet from the head box 4 there between. Downstream the forming roll 6, there is a forming zone 11, where the stock by means of dewatering creates a continuous fibre web 12, in this position being carried by the inner one of said forming wires 8. For the dewatering, the wire section 5 comprises a steam box 13, on one hand, being arranged outside the inner wire 8 loop in order to heat the fibre web 12, and a suction box 14, on the other hand, being arranged inside the inner wire 8 loop in order to remove water from the fibre web 12 through apertures in the inner wire 8. Accordingly, in principle, the above-described wire section 5 is a conventional twin-wire section, where the fibre web 12 downstream the suction box 14 has a dryness within the interval 20-25%.

Downstream the wire section 5, the wet end 2 comprises a structuring section 15, extending from the wire section 5 all the way to the drying section 3. The structuring section 15 comprises a clothing 16, running in a closed loop around a plurality of guide rolls 17. A transfer box 18 is arranged inside the clothing 16 loop in order to transfer the fibre web 12 from the wire section 5 to the structuring section 15. More precisely, the transfer box 18 is arranged between two of said guide rolls 17 in order to bring the clothing 16 against the inner wire 8 and, by means of negative pressure, pick up the fibre web 12 from the inner wire 8. Preferably, there is a certain negative draw in the transfer section or at the transfer point, i.e. the speed of clothing 16 is preferably arranged for being lower than the speed of the inner wire 8, wherein a wet creping effect is obtained in the transfer section or at the transfer point. The speed difference in the negative draw can be up to 30%, but is preferably within the interval 0-20%, depending on the product which is to be produced.

The clothing 16 is air and water permeable with an air permeability within the interval 100-700 CFM, preferably 400-600 CFM. In this context, CFM refers to cubic feet of air passed through per minute and square foot clothing at a pressure of 127 Pa, which corresponds to a water head of 0.5 inches. Furthermore, the clothing 16 exhibits a three-dimensional and apertured, i.e. open, structure, exhibiting a plurality of through holes in the thickness direction, enabling the clothing 16 to receive the fibre web 12 in order to build up a high bulk. In other words, the three-dimensional structure of the clothing 16 receives the fibre framework of the fibre web 12 and forms a three-dimensional fibre web 12 of a high bulk. Preferably, the clothing 16 is wire-like, i.e. made of woven threads, preferably of polyester. For instance, the clothing 16 can be one of the clothing types known under the designations GST and MST. Trials have demonstrated that a coarseness of 44×30 threads per inch is suitable for the paper grade "towel", i.e. kitchen roll-like paper, whereas 51×48 threads per inch is suitable for the paper grade "bath room", i.e. toilet paper. In principle, also so-called TAD-wires or TAD-fabrics can be used but, since the demands for air permeability and heat resistance which are made on TAD-wires or TAD-fabrics do not have to be granted in a paper machine according to the invention, considerably more wire or clothing qualities are usable, something which is reflected by the lower air permeability value, 100 CFM, which is considerably lower than those occurring with TAD-wires or TAD-fabrics. A moulded clothing can be used as an alternative to a woven fabric.

A large portion of the bulk of the fibre web 12 or fibre framework structure of the fibre web 12 is generated already by the transfer box 18, when the negative pressure inside the transfer box 18 forces the fibres or the fibre framework of the fibre web 12 into the three-dimensional structure of the clothing 16. Any negative draw at the transfer from the wire section 5 to the structuring section 15 amplifies this effect. The negative pressure inside the transfer box 18 can be within the high vacuum region, i.e. approx. 60-70 kPa, implying that also a certain dewatering takes place in the transfer section or at the transfer point. As an alternative, the negative pressure can be lower, for example 20-30 kPa, which is preferable when trying to obtain surface softness rather than bulk.

After the transfer box 18, the fibre web 12 is carried openly on the underside of the clothing 16. In this context, the clothing 16 is carrying the fibre web 12 openly means that the fibre web 12 has a free, i.e. uncovered side 19, when the fibre web 12 is carried by the clothing 16. The fact that the fibre web 12 is carried openly ensures that an efficient, bulk-preserving dewatering of the fibre web 12 can take place when the fibre web 12 is passing through the structuring section 15. For dewatering, the structuring section 15 comprises at least one dewatering unit 20, comprising at least one dewatering member or device facing towards the free side 19 of the fibre web 12. In the embodiment according to FIG. 1, the dewatering unit 20 comprises a steam box 21 being arranged outside the clothing 16 loop and facing towards the free side 19 of the fibre web 12, and which, accordingly, constitutes said at least one dewatering member or device, and a suction box 22 being arranged inside the clothing 16 loop opposite and/or downstream the steam box 21. Facing directly towards the free side 19 of the fibre web 12, the steam box 21 can raise the temperature of the fibre web 12 and the water contained therein in an efficient way, something which increases the dewatering capacity of the subsequent suction box 22 due to reducing the viscosity of the water. As an alternative, the dewatering members or devices in the dewatering unit 20 can be based upon another bulk-preserving dewatering technique, for example heating of the fibre web 12 by means of infrared radiation or hot air. Accordingly, the clothing 16 is arranged for carrying the fibre web 12 openly for a predetermined distance between the wire section 5 and the drying section 3, within which distance the free side 19 of the fibre web 12 is accessible to said at least one dewatering member or device. This predetermined distance can be the entire distance between the wire section 5 and the drying section 3 or only a part of this distance.

In the structuring section 15, i.e. from the wire section 5 all the way to the drying section 3, the fibre web 12 is supported or carried by the clothing 16. A smooth and solid transfer roll 23 is arranged inside the clothing 16 loop in order to transfer the fibre web 12 from the clothing 16 of the structuring section 15 to a hot drying surface 24 of the drying section 3. More precisely, the transfer roll 23 is arranged for interacting with the drying surface 24 in order to form a transfer nip 25 for the fibre web 12. In order to facilitate the transfer of the fibre web 12 to the drying surface 24, the clothing 16 exhibits flat portions on its outside surface, which are arranged for creating a contact surface for interaction with the drying surface 24 during the passage of the clothing 16 through the transfer nip 25. Thereby, the flat portions preferably constitute 15-40%, preferably 22-28%, for example 25%, of the clothing's 16 contact surface against the drying surface 24. The flat portions can be obtained, for example, by means of surface grinding or rolling of the clothing 16. Owing to the three-dimensional structure of the clothing 16, in combination with the flat portions, an efficient transfer of the fibre web 12 is obtained while preserving the bulk of the fibre web 12, i.e. while preserving the three-dimensional structure of the fibre framework of the fibre web 12 that was created in the three-dimensional structure of the clothing 16. It is true that the fibre web 12 could be somewhat compacted mechanically in certain spots, where the flat portions are interacting with the drying surface 24, but the linear load in the transfer nip 25 is low on average, and this local effect on less than 50% of the surface of the fibre web 12 does not influence the total bulk value of the fibre web 12. Additionally, no dewatering takes place in the transfer nip 25. It should be emphasized here that the paper machine 1 is entirely free of dewatering pressing nips, something which provides for high bulk values of the produced soft paper.

Preferably, the drying section 3 comprises a Yankee cylinder 26 having a hood 27. Thereby, the shell surface of the Yankee cylinder 26 constitutes said drying surface 24 for the fibre web 12. Preferably, adhesive chemicals, which are applied onto the drying surface 24 by means of nozzles 28 being arranged at the Yankee cylinder 26 before the transfer nip 25, are used in order to ensure the desired adhesion between the fibre web 12 and the drying surface 24. On the hot drying surface 24, the fibre web 12 is dried to a dryness of about 97-98%, whereupon the fibre web 12 is removed from the drying surface 24, for instance by means of a creping doctor 29. The purpose of the adhesive chemicals is also to protect the drying surface 24 from wear.

Figure 2:
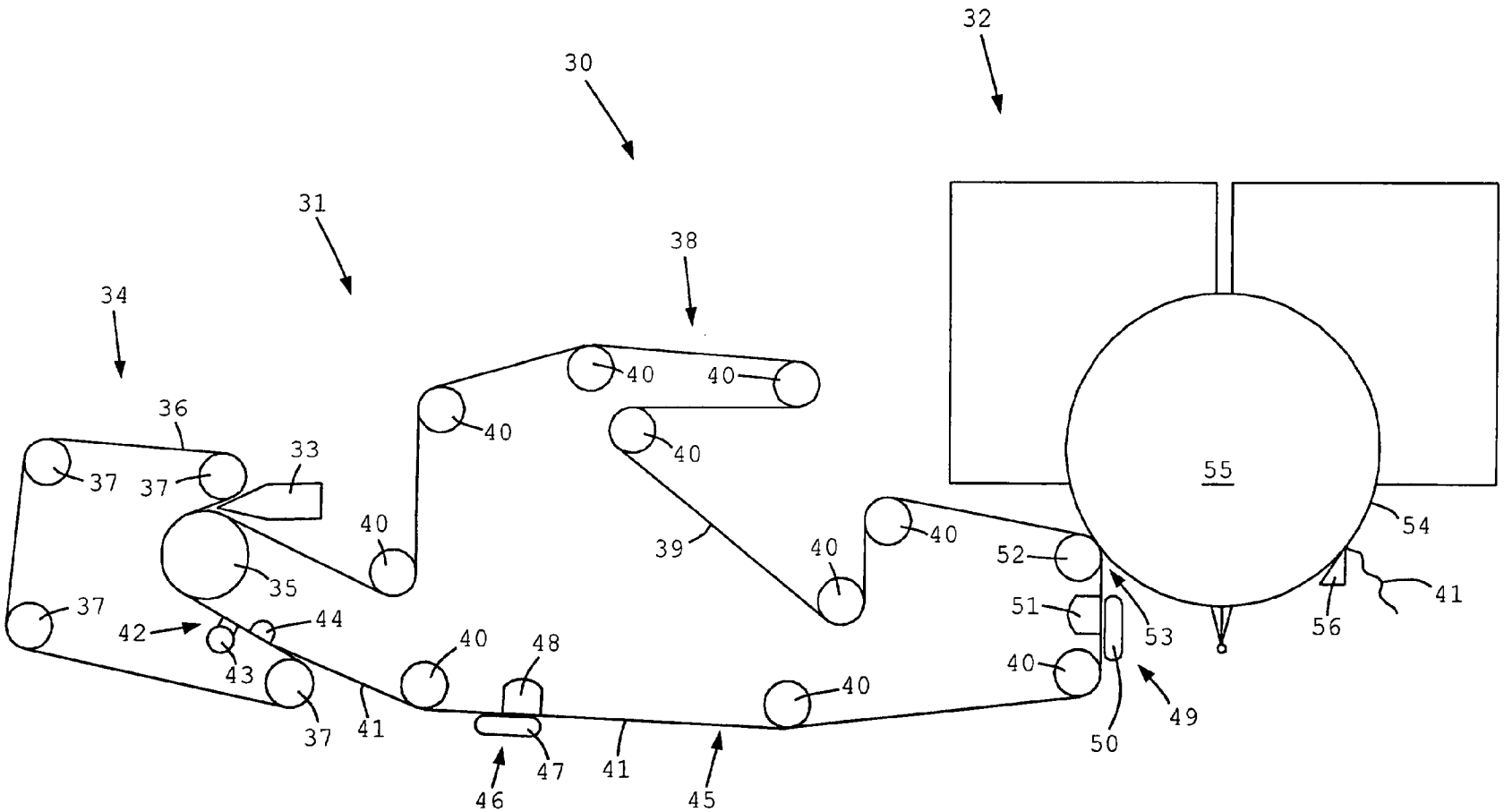
FIG. 2 shows a second embodiment of a paper machine according to the invention.

FIG. 2 is a schematic representation of an alternative embodiment of a paper machine 30 for manufacturing soft paper. The paper machine 30 comprises a wet end 31 and a drying section 32 but, like the previously described embodiment, it lacks a press section. The wet end 31 comprises a head box 33 and a wire section 34. The wire section 34, in its turn, comprises a forming roll 35 and a forming wire 36, running in a loop around a plurality of guide rolls 37 and over the forming roll 35. Furthermore, the wet end 31 comprises a structuring section 38, comprising a clothing 39 of the same type as in the paper machine 1 according to FIG. 1. The clothing 39 runs in a closed loop around a plurality of guide rolls 40, but in this case, however, it also extends into the wire section 34 where it runs around the forming roll 35 instead of the inner forming wire 8 as in FIG. 1. Accordingly, the head box 33 is arranged for delivering a stock jet between the forming wire 36 and the clothing 39, and the stock is dewatered and forms a continuous fibre web 41 in a forming zone 42 directly onto the clothing 39. For the dewatering of the stock, the wire section 34 comprises a dewatering box 43 arranged inside the forming wire 36 loop. Downstream the forming zone 42, a transfer box 44 is arranged inside the clothing 39 loop in order to ensure that the fibre web 41 follows the clothing 39 when the forming wire 36 and the clothing 39 are separated from each other. Accordingly, downstream the transfer box 44, the fibre web 41 is carried openly on the underside of the clothing 39, and the fibre web 41 has a free, uncovered side 45. In order to increase the dryness of the fibre web 41 even more, the wet end 31 comprises a first dewatering unit 46, downstream the transfer box 44, comprising a first dewatering member or device in the form of a steam box 47 and a second dewatering member or device in the form of a so-called "moulding box" 48, i.e. a suction box which is arranged partly for dewatering, and partly for structuring the fibre web 41. Thereby, the steam box 47 is arranged outside the clothing 39 loop, so that it is facing towards the free side 45 of the fibre web 41, and the suction box 48 is arranged inside the clothing 39 loop. Downstream the first dewatering unit 46, the paper machine 30, on the whole, is designed as the paper machine 1 described previously. The fibre web 41 passes through a second dewatering unit 49, corresponding to the dewatering unit 20 in FIG. 1 and comprising a steam box 50 and a suction box 51. Thereby, the steam box 50 is arranged outside the clothing 39 loop in order to be facing directly towards the free side 45 of the fibre web 41. After the dewatering unit 49, the fibre web 41 is transferred, via a smooth, solid transfer roll 52 and a transfer nip 53, to a drying surface 54 in the form of the shell surface of a hood-equipped Yankee cylinder 55. Finally, the fibre web 41 is removed from the shell surface 54, for instance by means of a creping doctor 56.

Figure 3:
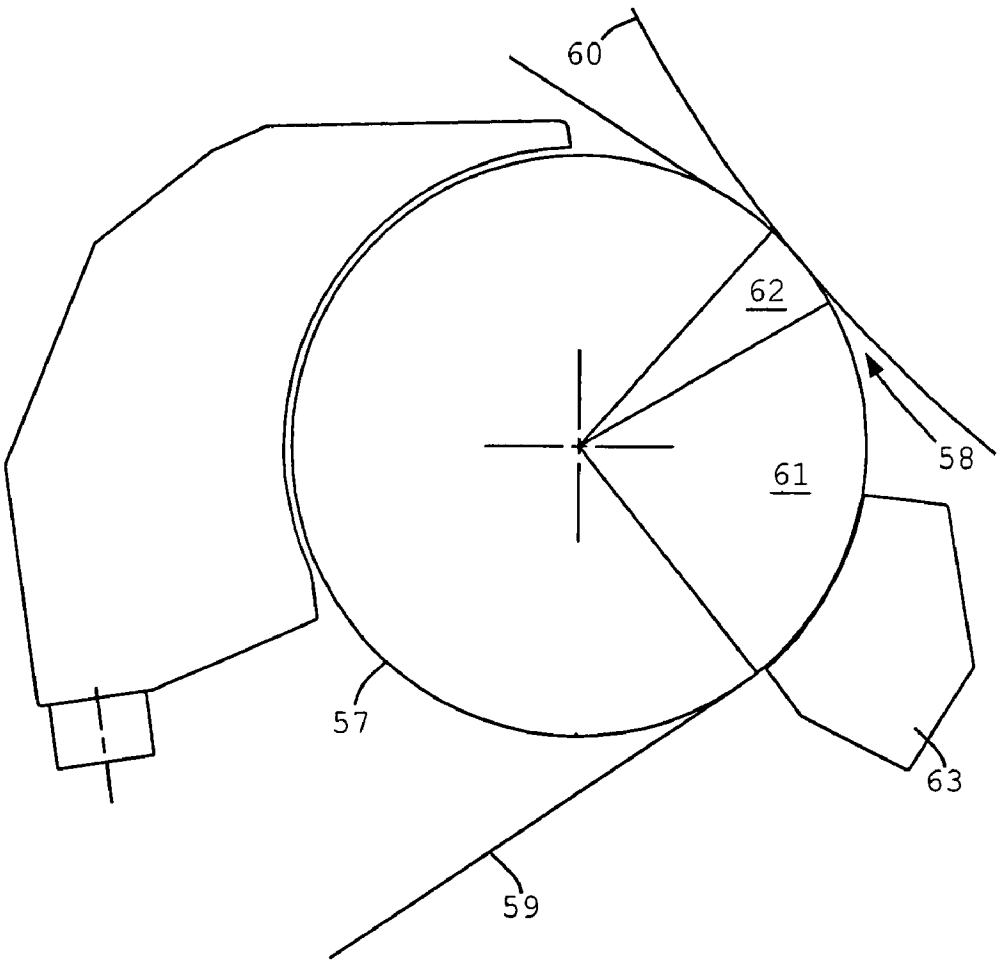
FIG. 3 shows an alternative embodiment of a transfer roll for a paper machine according to the invention.

FIG. 3 is a schematic representation of an alternative embodiment of a transfer roll for a paper machine according to the invention. The transfer roll 57, being a suction roll, utilises the pressure increase which after all is present in the transfer nip 58, in order to increase the dryness of the fibre web 59 even more before it is transferred to the drying surface 60. The transfer roll 57 comprises a low vacuum zone 61, and a high vacuum zone 62, being located downstream the former and being arranged just opposite the transfer nip 58. A steam box 63 is arranged directly opposite the transfer roll 57 for increasing the temperature of the fibre web 59 to about 80-90° C. before the fibre web 59 runs over the low vacuum zone 61. This temperature increase results in two advantages; that the viscosity of the water inside the fibre web 59 is reduced, which increases the dewatering in the subsequent vacuum zones, and that the cooling of the drying surface 60 by the fibre web 59 is reduced, which increases the drying capacity of the Yankee cylinder. In the low vacuum zone 61, the pressure is relatively low, approx. 20-30 kPa. The purpose of the low vacuum zone is to initiate the steam flow path out from the clothing. In the high vacuum zone 62, the negative pressure is higher, approx. 60-70 kPa. The actual dewatering, when steam and water is removed from the fibre web 59 through the clothing, takes place in this zone. Furthermore, the pressure in the transfer nip 58 is utilised for achieving so-called "flashing" of the steam, something which increases the dryness of the fibre web 59 even more.

Primarily, the paper machine according to the invention is intended for manufacturing the paper grades "towel" and "bath room". In "towel" grade, preferably 70-100 per cent by volume of softwood pulp and 0-30 per cent by volume of hardwood pulp are utilised, wherein 0-30 per cent by volume of the pulp consists of chemi-thermomechanical pulp (CTMP). In "bath room" grade, preferably 20-60 per cent by volume of softwood pulp and 40-80 per cent by volume of hardwood pulp are utilised. The average length of the fibres is 0.5-3.0 millimeters both in the softwood and hardwood pulp. In both paper grades, between 0 and 100% of the pulp can consist of recycled fibres. Before converting, the manufactured paper grade "towel" has a bulk within the interval 15-20 cubic centimeters per gram and a grammage of approx. 20 grams per square meter, whereas the paper grade "bath room" has a bulk within the interval 12-18 or 14-18 cubic centimeters per gram and a grammage between 15 and 24 grams per square meter.

A paper machine according to the invention with a 12 foot Yankee cylinder can be operated at the speed 480 m/min with the paper grade "towel", and with a 23 foot Yankee cylinder at the speed 1200 m/min with the paper grade "bath room".

In the foregoing, the invention has been described starting from a few specific embodiments. It will be appreciated, however, that modifications and alternative embodiments are possible within the scope of the invention.

The invention claimed is:

1. A paper machine (1, 30) for manufacturing a fibre web (12, 41) of paper without through air drying (TAD) and without any dewatering press nips, the paper machine comprising:

a wet end (2, 31), comprising a wire section (5, 34) comprising:

at least one forming wire (7, 8, 36) for forming the fibre web (12, 41); and a structuring section (15, 38) comprising:

a clothing (16, 39), being air and water permeable and exhibiting a three-dimensional structure for structuring the fibre web; and at least one dewatering unit (20, 46, 49) for dewatering the fibre web (12, 41);

a drying section (3, 32), comprising a drying surface (24, 54) for drying the fibre web (12, 41); and a transfer roll (23, 52), being arranged for interacting with the drying surface (24, 54) at a transfer nip (25, 53) for transferring the fibre web (12, 41) from the wet end (2, 31) to the drying section (3, 32); wherein:

the fibre web (12, 41) is supported by said clothing (16, 39) from the wire section (5, 34) all the way to and through the transfer nip (25, 53);

the clothing is arranged for picking up the fibre web from said at least one forming wire and for carrying the fibre web openly so that the fibre web has a free side (19, 45);

the at least one dewatering unit comprises a steam box (21, 47, 50) being arranged for facing towards the free side of the fibre web and a suction box (22, 48, 51) being arranged inside a loop of the clothing opposite or downstream of the steam box; and the transfer roll is a smooth roll allowing a transfer of the fibre web from the clothing to the drying surface without any dewatering of the fibre web as the fibre web passes through the transfer nip.

2. A paper machine (1, 30) according to claim 1, characterized in that said drying surface (24, 54) is coated with adhesive chemicals.

3. A paper machine (1) according to claim 1, wherein the speed of the clothing (16), when picking up the fibre web from the at least one forming wire, is 0-30% lower than the speed of the forming wire (8).

4. A paper machine (1, 30) according to claim 1, characterized in that the clothing (16, 39) is apertured.

5. A paper machine (1, 30) according to claim 4, characterized in that the clothing (16, 39) has an air permeability which is about 100-700 CFM.

6. A paper machine (1, 30) according to claim 5, characterized in that the clothing (16, 39) has an air permeability which is about 400-600 CFM.

7. A paper machine (1, 30) according to claim 1, characterized in that the clothing (16, 39) has, on one of its sides, flat portions being arranged for interacting with the drying surface (24, 54) in the transfer nip (25, 53).

8. A paper machine (1, 30) according to claim 7, characterized in that the area of said flat portions constitutes 15-40% of the clothing's (16, 39) contact surface against the drying surface (24, 54).

9. A paper machine (1, 30) according to claim 8, characterized in that the area of said flat portions constitutes 22-28% of the clothing's (16, 39) contact surface against the drying surface (24, 54).

10. The paper machine according to claim 8, wherein the area of said flat portions constitutes 25%, of the clothing's contact surface against the drying surface.

11. A paper machine (1, 30) according to claim 1, characterized in that the transfer roll (23, 52) is homogenous.

12. A paper machine (1, 30) according to claim 1, characterized in that the drying section (3, 32) comprises a creping doctor (29, 56) for creping the fibre web (12, 41).

13. A paper machine (1, 30) according to claim 1, characterized in that said three-dimensional structure of the clothing (16, 39) is arranged on the side of the clothing (16, 39) facing towards the fibre web (12, 41).

14. The paper machine according to claim 1, wherein the speed of the clothing, when picking up the fibre web from the at least one forming wire, is 0-20% lower than the speed of the forming wire.

15. A method for manufacturing paper in a paper machine (1, 30) without through air drying (TAD) and without dewatering press nips, said method comprising the steps of:

forming a fibre web (12, 41) in a wire section (5, 34);

transferring the fibre web from a forming wire (8) of the wire section to a clothing (16, 39), the clothing being air and water permeable and exhibiting a three-dimensional structure;

supporting the fibre web (12, 41) by the clothing (16, 39) from the wire section (5, 34) to a drying section (3, 32), whereby the clothing carries the fibre web openly so that the fibre web has a free side (19);

dewatering the fibre web (12, 41) from the wire section to the drying section by at least one dewatering unit (20, 46, 49);

transferring the fibre web (12, 41) from the clothing (16, 39) to a drying surface (24, 54) of the drying section (3, 32); and removing the fibre web (12, 41) from the drying surface (24, 54), wherein:

the at least one dewatering unit comprises a steam box (21, 47, 50) being arranged for facing towards the free side of the fibre web and a suction box (22, 48, 51) being arranged inside a loop of the clothing opposite or downstream of the steam box; and the transfer roll is a smooth roll allowing a transfer of the fibre web from the clothing to the drying surface without any dewatering of the fibre web as the fibre web passes through the transfer nip.

16. A method according to claim 15, characterized by the step of coating said drying surface (24, 54) with adhesive chemicals.

17. A method according to claim 15, wherein the speed of the clothing is 0-30% lower than the speed of the forming wire (8) during the transfer of the fibre web from the forming wire to the clothing.

18. A method according to claim 15, characterized by the step of creping the fibre web (12, 41) and removing it from the drying surface (24, 54) by a creping doctor (29, 56).

19. A method according to claim 15, characterized by forming a three-dimensional structure of the fibre web (12, 41) on the side of the fibre web (12, 41) facing the clothing (16, 39).

20. The method according to claim 15, wherein the speed of the clothing is 0-20% lower than the speed of the forming wire during the transfer of the fibre web from the forming wire to the clothing.

* * * * *